US005388438A

United States Patent [19]

Haavikko Paavo

[11] Patent Number: 5,388,438

[45] Date of Patent: Feb. 14, 1995

[54] CYLINDER LOCK WITH DETENT DISKS

[76] Inventor: Haavikko Paavo, Bulevardi 19 C, SF-00120 Helsinki, Finland

[21] Appl. No.: 50,354

[22] PCT Filed: Nov. 14, 1990

[86] PCT No.: PCT/FI90/00272

§ 371 Date: Apr. 30, 1993

§ 102(e) Date: Apr. 30, 1993

[87] PCT Pub. No.: WO92/08862

PCT Pub. Date: May 29, 1992

[30] Foreign Application Priority Data

Jun. 1, 1989 [FI] Finland ..... 892658

[51] Int. Cl.[6] ..... E05B 29/08

[52] U.S. Cl. ..... 70/366; 70/377; 70/419

[58] Field of Search ..... 70/356, 365, 366, 377, 70/405–407, 409, 417–421

[56] References Cited

U.S. PATENT DOCUMENTS

| | | | |
|---|---|---|---|
| 2,613,528 | 10/1952 | Salmivuori | 70/366 |
| 3,789,638 | 2/1974 | Roberts et al. | 70/417 X |
| 3,928,992 | 12/1975 | Talbot | 70/366 |
| 3,948,065 | 4/1976 | Martikainen | 70/366 X |
| 4,008,588 | 2/1977 | Miller et al. | 70/366 |
| 4,062,211 | 12/1977 | Miller et al. | 70/417 X |
| 4,083,212 | 4/1978 | Proefrock | 70/366 |
| 4,624,119 | 11/1986 | Newman et al. | 70/366 |
| 4,667,493 | 5/1987 | Takahashi | 70/366 |
| 5,205,143 | 4/1993 | Hakkarainen et al. | 70/366 |

FOREIGN PATENT DOCUMENTS 8911014 11/1989 WIPO .

*Primary Examiner*—Peter M. Cuomo
*Assistant Examiner*—Suzanne Dino
*Attorney, Agent, or Firm*—Merchant, Gould, Smith, Edell, Welter & Schmidt

[57] ABSTRACT

A disk detent cylinder lock comprising a stationary outer cylinder (1); an inner cylinder (2) which has been disposed within the outer cylinder; and a plurality of detent disks ($3^1$, $3^2$, $3^3$, . . . ) which have been disposed to form a disk stack (4) within the inner cylinder to be turnable with the proper key of the lock from their locking positions into opening positions. The lock comprises locking members for preventing lock-picking in a lock-picking situation.

8 Claims, 4 Drawing Sheets

CYLINDER LOCK WITH DETENT DISKS

Figure 1:
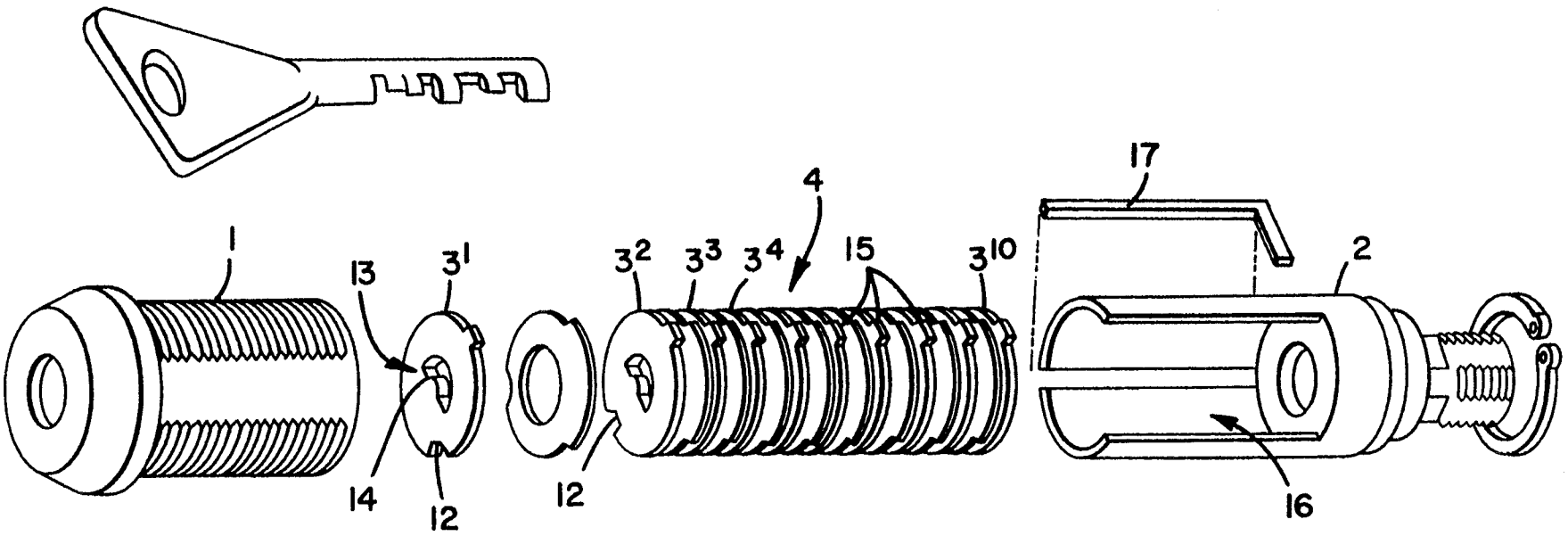
FIG. 1 PRIOR ART

The present invention concerns a cylinder lock with detent disks, as defined in the preamble to claim The typical disk detent cylinder lock of prior art is of the kind which comprises a stationary outer cylinder within which an inner cylinder is disposed. Within the inner cylinder a plurality of detent disks have been arranged to constitute a disk stack, these disks being turnable from their locking positions into the opening positions, using a key. Each detent disk comprises a peripheral notch located on the periphery; a key aperture constituting a key channel; and a tail member located on the periphery, which in cooperation with the inner cylinder turning aperture has been arranged to delimit the path of the disk detent to a given circular sector. Furthermore, the lock comprises a detent bar which in the locked position interlocks the inner cylinder with the outer cylinder. When all detent disks have been turned to be in register with the detent bar, the detent bar is arranged to release the inner cylinder to be free to turn relative to the outer cylinder for opening the lock, in that the detent bar enters the groove constituted by the peripheral notches.

It is a serious problem in disk detent cylinder locks known in the art, that the are comparatively easy to open by various lock-picking methods.

One of these lock picking methods is based on the fact that the individual detent disks of the lock can be moved one by one, independent of each other, into their opening positions, e.g. by turning the detent disks to and fro with a suitable implement inserted through the key channel. It is easy for a person picking locks to acquire a fingertip sensitivity enabling him, when he turns a detent disk, to feel that particular point at which the peripheral notch of the individual detent disk is in register with the detent bar, that is, in the opening position.

The object of the invention is to provide a disk detent cylinder lock which solves this problem.

It is a particular object of the invention to provide a disk detent cylinder lock which cannot be opened with any implements other than the specific key defined for the particular lock.

The disk detent cylinder lock of the invention is characterized by that which is stated in claim 1.

As taught by the invention, the disk detent cylinder lock comprises locking members for mutually interlocking the detent disks in a lock-picking situation in order to prevent lock picking. The lock picking act is prevented in that the detent disks are so interlocked that they cannot be turned to and fro independent of each other in an attempt to find the opening position.

In an embodiment of the lock the locking members include a locking bar axial to the disk stack and connecting two so-called 0 detent disks, and at least on one other detent disk a stop member for interlocking the detent disks in cooperation with the locking bar. A so-called 0 detent disk is understood to be a detent disk which when turning it into the opening position is turned most, i.e., through the whole sector defined by the turning aperture of the inner cylinder.

In an embodiment of the lock the locking bar is arranged to connect the foremost and rearmost detent disk in the disk stack, which disks are so-called 0 disks. The locking bar will then act in cooperation with the stop member on at least one detent disk located between the foremost and rearmost detent disks. Advantageously, every detent disk in this interval carries a stop member, whereby all detent disks are mutually interlocked by effect of the locking bar and of the stop members when the foremost and rearmost detent disk have been turned into a position in which the locking bar and the stop members come into interaction.

In an embodiment of the lock the housing of the inner cylinder comprises a space for movement of the locking bar, and the housing comprises a guiding surface for guiding the locking bar into cooperation with the stop member.

In an embodiment of the lock the guiding surface has been formed so that the locking bar comes into contact with the guiding surface at the ultimate stage of the turning motion. Entering of the locking bar into interaction with the stop member will then take place when the 0 detent disks have been turned into the opening position.

In an embodiment of the lock the locking bar comprises turning arms which are turnably pivoted to two 0 detent disks, preferably to the foremost and rearmost detent disk. With the aid of said turning arms the axial locking bar turns into a position interlocking the detent disks when the locking bar, turning, comes into contact with the guiding surface on the margin of the space for movement which has been provided in the inner cylinder, whereby the guiding surface turns the turning arms and the locking bar is urged against the stop member on the detent disk.

In an embodiment of the lock the stop member of the detent disk is a notch provided on the periphery of the detent disk.

In an embodiment of the lock a plurality of side-by-side notches have been provided on the periphery of the detent disk, these notches constituting stop members. The notches are preferably round in shape in the peripheral direction, e.g. undulating, for easier guiding of the locking bar into the notch and release therefrom.

In an embodiment of the lock the locking members comprise a locking bar connected to one so-called 0 detent disk and a stop member belonging to a detent disk immediately adjacent to said 0 detent disk, for interlocking the detent disks in cooperation with the locking bar. The locking bar may equally be a pin-like member connected to one single 0 detent disk and acting on a stop member on the adjacent detent disk. In this case the locking member will on attempted lock-picking only interlock these detent disks with each other but it will have no effect on the rest of the detent disks. Said 0 detent disk may be any one of the detent disks in the disk stack.

In an embodiment of the lock the locking bar comprises one turning arm, turnably pivoted on a 0 detent disk. In that case the locking bar is a crank-shaped member.

The advantage of the invention is that it inhibits effectively the use of known lock-picking methods.

It is a further advantage of the invention that existing disk detent cylinder locks known in the art can be modified with ease to conform to the present invention, merely by replacing a few parts.

Figure 2:
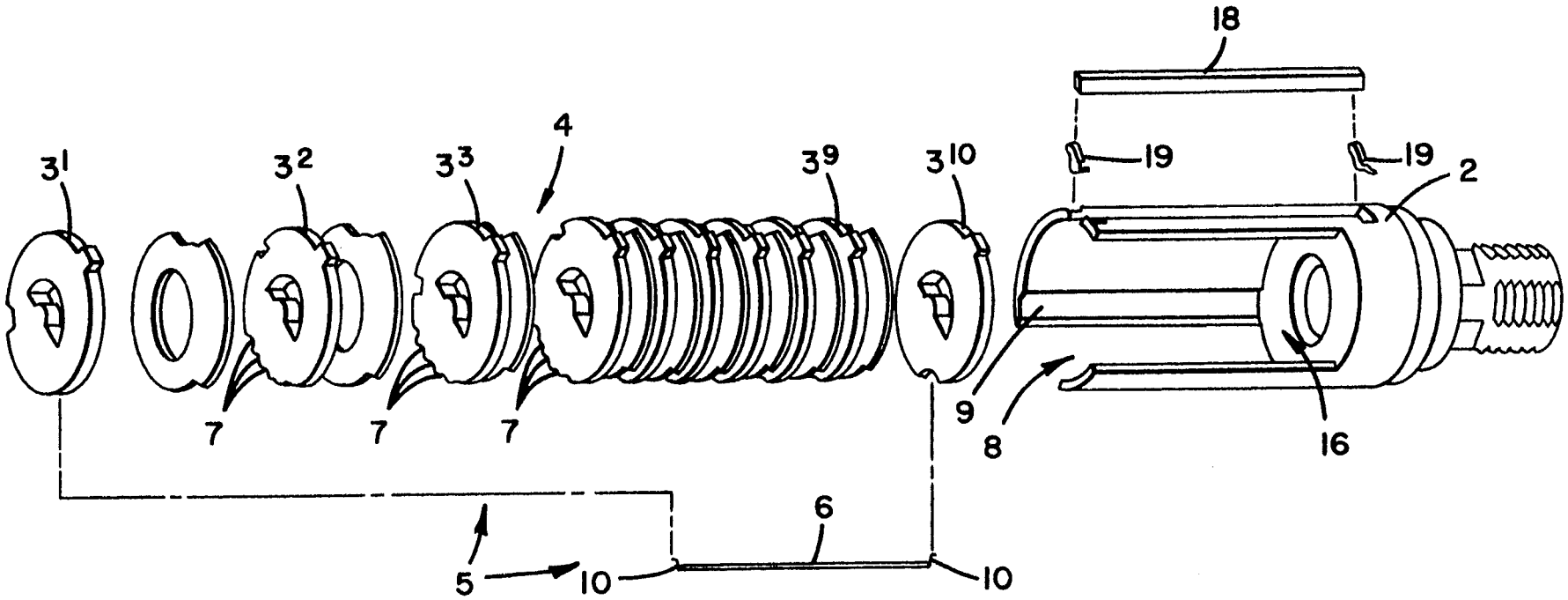
Figure 3:
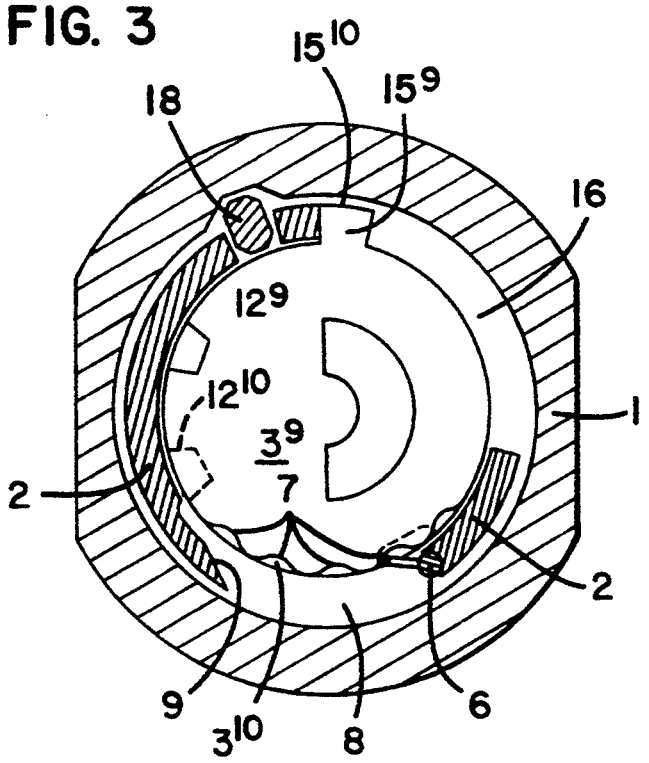
Figure 4:
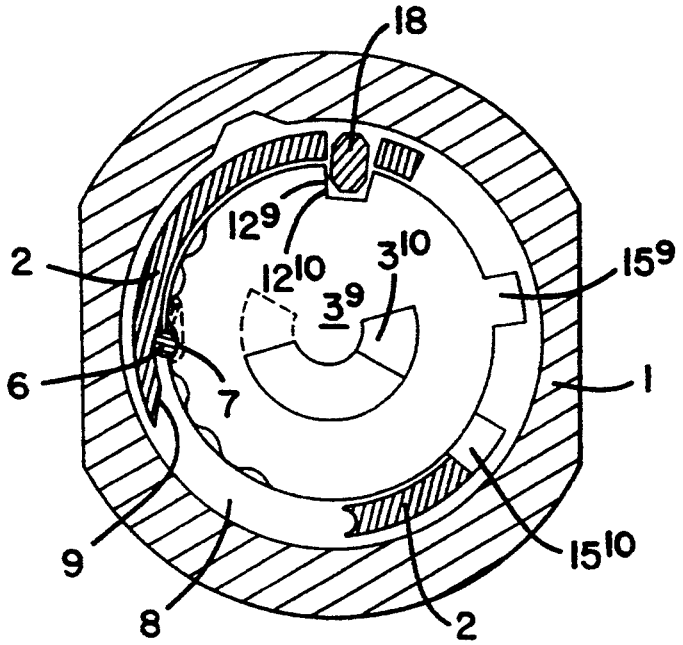
Figure 5:
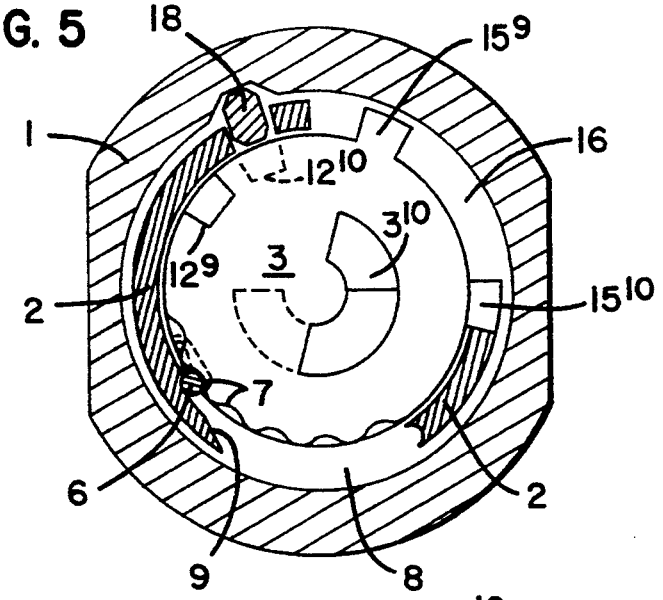
Figure 6:
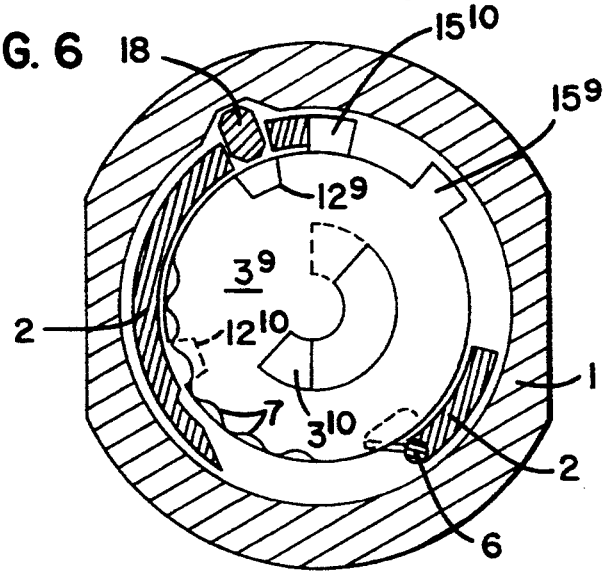
Figure 7:
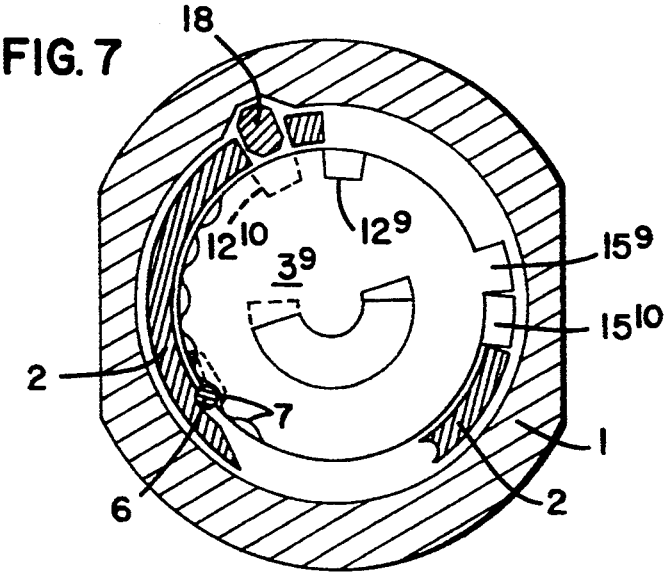

The invention is described in detail in the following, referring to the attached drawing, wherein:

FIG. 1 presents in axonometric exploded view, a disk detent cylinder lock of prior art;

FIG. 2 presents in axonometric exploded view, an embodiment of the disk detent cylinder lock of the invention;

FIG. 3 presents the cross section of another embodiment of the disk detent cylinder lock of the invention, carried at the location of the rearmost but one detent disk, as seen in the direction in which the key is pushed in, with the detent disks in the key-inserting position;

FIG. 4 presents the embodiment of FIG. 3 with the detent disks in opening position, for opening the lock;

FIG. 5 presents the embodiment of FIG. 3 with the rearmost detent disk turned into position and locking the rearmost but one detent disk;

FIG. 6 presents the embodiment of FIG. 3 with the rearmost but one detent disk turned into opening position; and FIG. 7 presents the embodiment of FIG. 3 with the rearmost detent disk turned into opening position after the initial situation of FIG. 6.

The disk detent cylinder lock depicted in FIG. 1, known in the art, comprises a stationary outer cylinder 1 and an inner cylinder 2, the latter being disposed within the outer cylinder. The lock furthermore comprises a number of detent disks $3^1$, $3^2$, $3^3$, . . . which are arranged in a disk stack 4 inside the inner cylinder, to be turnable with the key from their locking positions into opening positions. Each detent disk presents a peripheral notch 12 located on the periphery, a key aperture 14 located in the centre and forming the key channel 13, and a tail member 15 located on the periphery. In cooperation with the turning aperture 16 of the inner cylinder, said tail member 15 limits the paths of the detent disks to a given circular sector. The lock moreover comprises a detent bar 17 which in the locked position interlocks the inner cylinder with the outer cylinder. When the peripheral notches of all detent disks have been turned to be in register with the detent bar 17, the detent bar enters the groove which is formed by the peripheral notches, whereby the inner cylinder is set free to turn relative to the outer cylinder and the lock opens. A lock of this type is comparatively easy to pick by moving the individual detent disks into their opening positions, independent of each other. As taught by the invention, the disk detent cylinder lock of FIG. 2 comprises locking members 5 for mutually interlocking the detent disks $3^1$, $3^2$, $3^3$, . . . in a lock-picking situation, in order to prevent picking of the lock.

The locking members 5 include a locking bar 6 axial to the disk stack 4 and connecting two so-called detent disks $3^1$, $3^{10}$. The locking bar 6 is disposed to connect with each other the foremost $3^1$ and rearmost $3^{10}$ detent disks in the disk stack.

The locking members 5 further comprise stop members 7 belonging to the detent disks $3^2$, $3^3$, . . . , $3^9$ between the foremost and rearmost detent disks, for mutually interlocking the detent disks in cooperation with the locking bar. The stop member 7 of the detent disks $3^2$, $3^3$, . . . , $3^9$ is a notch provided on the periphery of the detent disk. Several side-by-side notches have been provided on the periphery of the detent disk $3^2$, $3^3$, . . . , $3^9$.

The housing of the inner cylinder 2 provides a moving space 8 for the locking bar 6. The housing furthermore features a guiding surface 9 for guiding the locking bar 6 into cooperation with the stop members 7.

The guiding surface 9 has been formed such that the locking bar 6 comes into contact with the guiding surface at a stage towards the end of the turning motion.

The locking bar 6 comprises turning arms 10 which are turnably pivoted to the foremost 0 detent disk $3^1$ and to the rearmost 0 detent disk $3^{10}$.

The detent bar 18 is preferably designed to be elastically mounted at both ends, relative to the inner cylinder, with springs 19. The springs 19 are springs made in a suitable manner of band-like spring steel material, and they are disposed between the inner cylinder 2 and the detent bar 18 to act on the latter.

In FIG. 3 is shown in cross section a disk detent cylinder lock according to the present invention. The lock has been cross-sectioned in front of the second rearmost detent disk $3^9$, as seen in the key inserting direction. Behind the detent disk $3^8$ lies the rearmost detent disk $3^{10}$ of the lock, which is a so-called 0 detent disk. The detent disks $3^9$ and $3^{10}$ are in identical position in the figure, i.e., in the key inserting position. The detent disk $3^9$ has on its lower margin a set of notches which constitute the stop members 7 for the locking bar 6. Since the rearmost detent disk $3^{10}$ is in such position as has been stated, the locking bar 6 is located at the right margin of the space 8, against the inner cylinder 2.

In FIG. 4 the lock has been depicted in the situation that the lock has been opened with the key. The detent disks $3^9$ and $3^{10}$ are both in the opening position, the tail member $15^{10}$ of the detent disk $3^{10}$ being located at the extreme margin of the turning aperture 16. The peripheral notches $12^9$ and $12^{10}$ of the detent disks are in register, and the detent bar has entered these notches. On turning the key, the inner cylinder 2 will turn relative to the outer cylinder 1 and the lock will open. When the detent disks are being turned close to their opening position, the guiding surface 9 will guide the locking bar 6 to turn against the stop member 7, thus interlocking the detent disks relative to each other. When the sequential arrangement of the detent disks on turning the key is arranged so that they are in proper order in their opening positions before the locking bar 6 gets involved with the guiding surface 8, the mutual interlocking of the detent disks is no obstruction whatsoever when the lock is being opened with the proper key.

In FIG. 5 the lock of FIG. 3 is depicted in a situation in which lock-picking has been attempted by first turning the rearmost detent disk $3^{10}$ into opening position, whereby the tail member $15^{10}$ of the detent disk $3^{10}$ is located at the extreme margin of the turning aperture 16. The peripheral notch $12^{10}$ of the rearmost detent disk $3^{10}$ lies under the detent bar 18 in opening position. At turning the rearmost detent disk $3^{10}$ into opening position the locking bar 6 has come into contact with the guiding surface 9, and the 9 has lifted the locking bar up against the stop member 7 of detent disk $3^9$, whereby they have become interlocked with each other. Therefore the next step in the lock-picking process is inhibited because the detent disk $3^9$, or any other detent disk that has been locked with the locking members, cannot be turned hereafter.

In FIG. 6 the lock of FIG. 3 is seen in a situation in which the lock-picker has commenced his lock picking by turning the detent disk $3^9$ into opening position, whereby the peripheral notch $12^9$ is in register with the detent bar 18. The rearmost detent disk $3^{10}$ remains in its initial position, whereby its tail member $15^{10}$ is on top in the figure and the locking bar 6 connected to the detent disk $3^{10}$ lies against the right margin of the space 8. In a position such as this, detent disks other than those provided with a locking bar 6 can be freely turned and attempts can be made to find the opening position. However, ultimately in order to open the lock the detent disk $3^{10}$ must also be turned into opening position. This results in the situation of FIG. 7.

FIG. 7 depicts the situation occurring in continuation of that shown in FIG. 6, after the detent disk $3^{10}$ has been turned into opening position, whereby the detent notch $12^{10}$ comes to lie under the detent bar 18 in the opening position. The locking bar 6 will now engage with the stop member 7 of detent disk $3^9$ and turn the detent disk $3^9$ further, thus deflecting the detent notch $12^9$ of detent disk $3^9$, which had just before been brought into register, away from the opening position and locking the detent disk $3^9$ to be stationary relative to the detent disk $3^{10}$. Therefore the lock cannot be opened by this lock-picking procedure either.

In the examples illustrated by the figures, the operation of the lock has in the interest of clarity been described in terms of two detent disks only, but it is obvious that the locking members may be active also between several detent disks. The invention is not exclusively delimited to concern the embodiment examples presented in the foregoing; numerous modifications are feasible while staying within the scope of the inventive idea defined by the claims.

I claim:

1. A disk detent cylinder lock, comprising:

a stationary outer cylinder;

an inner cylinder being disposed within the outer cylinder, the inner cylinder comprising a housing with a turning aperture for determining a turning sector for a plurality of detent disks;

the detent disks being disposed to form a disk stack within the inner cylinder, each of the detent disks having a peripheral notch located on a periphery of said detent disk and at least one of said detent disks being a zero detent disk which turns said detent disk into an opening position through a whole sector defined by the turning aperture of the inner cylinder;

a detent bar interlocking the inner cylinder with the outer cylinder in a locked position of the disk detent cylinder lock, and in the locked position, all peripheral notches of the detent disks being turned to be in register with the detent bar, the detent bar being disposed to set free the inner cylinder to turn in relation to the outer cylinder to open the disk detent cylinder lock so that the detent bar enters a groove which is formed by the peripheral notches;

a plurality of locking members mutually interlocking the detent disks in a situation arising during lock-picking, said locking members comprising a locking bar confronting axially a periphery of the disk stack and a stop member on the detent disk for mutual interlocking of the detent disks in cooperation with the locking bar;

the locking bar being turnably connected to at least one zero detent disk for turning together therewith and the stop member being defined on at least one further detent disk; and the housing of the inner cylinder comprising a motion space for the locking bar, and a guiding surface located at a side of the motion space at the housing of the inner cylinder for guiding the locking bar into cooperation with the stop member at a stage towards an end of a turning motion, so that when said zero detent disk is turned to an extreme position towards a lock opening direction, the locking bar is by a guidance of the guiding surface in contact with the stop member of said at least one further detent disk thereby locking the zero detent disk together with said at least one further detent disk and with the inner cylinder.

2. A disk detent cylinder lock according to claim 1, wherein the locking bar is disposed to connect two zero detent disks together, the stop member is provided on one said further detent disk located between said two zero detent disks.

3. A disk detent cylinder lock according to claim 1, wherein the locking bar is connected to one zero detent disk, the stop member is provided on the detent disk immediately adjacent to said one zero detent disk.

4. A disk detent cylinder lock according to claim 3, wherein the locking bar comprises a turning arm which is turnably pivoted to said one zero detent disk.

5. A disk detent cylinder lock according to claim 1, wherein the locking bar is disposed to connect a foremost detent disk and a rearmost detent disk in the disk stack, which are zero detent disks.

6. A disk detent cylinder lock according to claim 3, wherein the locking bar comprises at least two turning arms which are turnably pivoted to two zero detent disks.

7. A disk detent cylinder lock according to claim 6, wherein the locking bar is disposed to connect a foremost detent disk and a rearmost detent disk in the disk stack, which are zero detent disks.

8. A disk detent cylinder lock according to claim 1, wherein on the periphery of the detent disk is provided several notches side by side, which constitute a plurality of the stop members.

* * * * *